US009435281B2

(12) United States Patent
Parrish et al.

(10) Patent No.: US 9,435,281 B2
(45) Date of Patent: Sep. 6, 2016

(54) METHOD FOR REDUCING PERFORMANCE VARIATION OF AN ELECTROMAGNETICALLY-ACTIVATED ACTUATOR

(71) Applicant: GM GLOBAL TECHNOLOGY OPERATIONS LLC, Detroit, MI (US)

(72) Inventors: Scott E. Parrish, Farmington Hills, MI (US); Ronald J. Zink, Macomb, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 14/675,925

(22) Filed: Apr. 1, 2015

(65) Prior Publication Data

US 2015/0285175 A1 Oct. 8, 2015

Related U.S. Application Data

(60) Provisional application No. 61/975,115, filed on Apr. 4, 2014.

(51) Int. Cl.

| | |
|---|---|
| ***F02D 41/20*** | (2006.01) |
| ***F02D 41/22*** | (2006.01) |
| ***F02D 41/40*** | (2006.01) |
| ***F02D 19/06*** | (2006.01) |
| *F02D 41/38* | (2006.01) |

(52) U.S. Cl.

CPC ..... *F02D 41/20* (2013.01); *F02D 19/0623* (2013.01); *F02D 41/22* (2013.01); *F02D 41/221* (2013.01); *F02D 41/222* (2013.01); *F02D 41/402* (2013.01); *F02D 2041/202* (2013.01); *F02D 2041/2051* (2013.01); *F02D 2041/2055* (2013.01); *F02D 2041/2072* (2013.01); *F02D 2041/389* (2013.01)

(58) Field of Classification Search

CPC .... F02D 19/0623; F02D 41/20; F02D 41/22; F02D 41/221; F02D 41/222; F02D 41/40; F02D 41/401; F02D 41/402; F02D 41/403; F02D 41/405

USPC ..... 123/480, 478, 479, 299, 300, 304; 701/114

See application file for complete search history.

(56) References Cited

U.S. PATENT DOCUMENTS

| | | | | |
|---|---|---|---|---|
| 2013/0133748 | A1* | 5/2013 | Lehner | F02D 41/247 137/1 |
| 2014/0092516 | A1* | 4/2014 | Koch | F02D 41/20 361/160 |
| 2014/0110508 | A1* | 4/2014 | Dames | H01F 7/1646 239/585.1 |

* cited by examiner

*Primary Examiner* — Mahmoud Gimie

(57) ABSTRACT

A method for reducing performance variation of an electromagnetically-activated actuator having an electrical coil and an armature includes providing actuator activation signals to the electromagnetically-activated actuator. The signals include current driven through the electrical coil in a first direction. The method detects unacceptable response variations in the armature to equivalent actuator activation signals. And, subsequent to detection of unacceptable response variations in the armature, current is driven through the electrical coil in a direction opposite that of the first direction following actuator activation signals.

15 Claims, 6 Drawing Sheets

METHOD FOR REDUCING PERFORMANCE VARIATION OF AN ELECTROMAGNETICALLY-ACTIVATED ACTUATOR

CROSS REFERENCE TO RELATED APPLICATIONS

This application claims the benefit of U.S. Provisional Application No. 61/975,115, filed on Apr. 4, 2014, which is incorporated herein by reference.

TECHNICAL FIELD

This disclosure is related to solenoid-activated actuators.

BACKGROUND

The statements in this section merely provide background information related to the present disclosure. Accordingly, such statements are not intended to constitute an admission of prior art.

Fuel injectors are used to directly inject pressurized fuel into combustion chambers of internal combustion engines. Known fuel injectors include electromagnetically-activated solenoid devices that overcome mechanical springs to open a valve located at a tip of the injector to permit fuel flow therethrough. Injector driver circuits control flow of electric current to the electromagnetically-activated solenoid devices to open and close the injectors. Injector driver circuits may operate in a peak-and-hold control configuration or a saturated switch configuration.

Fuel injectors are calibrated, with a calibration including an injector activation signal including an injector open-time, or injection duration, and a corresponding metered or delivered injected fuel mass operating at a predetermined or known fuel pressure. Injector operation may be characterized in terms of injected fuel mass per fuel injection event in relation to injection duration. Injector characterization includes metered fuel flow over a range between high flow rate associated with high-speed, high-load engine operation and low flow rate associated with engine idle conditions.

It is known to inject a plurality of small injected fuel masses in rapid succession for controlling an engine. Generally, when a dwell time between consecutive injection events is less than a dwell time threshold, injected fuel masses of subsequent fuel injection events often result in a larger delivered magnitude than what is desired even through equal injection durations are utilized. Accordingly, such subsequent fuel injection events can become unstable resulting in unacceptable repeatability. This undesirable occurrence is attributed to the existence of residual magnetic flux within the fuel injector that is produced by the preceding fuel injection event that offers some assistance to the immediately subsequent fuel injection event. The residual magnetic flux is produced in response to persistent eddy currents and magnetic hysteresis within the fuel injector. It is known to compensate for the effect of the larger than desired delivered magnitude of injected fuel mass solely by adjusting the injection duration of the subsequent injection event; however, the corresponding subsequent fuel injection may still become unstable resulting in unacceptable repeatability.

SUMMARY

A method for reducing performance variation of an electromagnetically-activated actuator having an electrical coil and an armature includes providing actuator activation signals to the electromagnetically-activated actuator. The signals include current driven through the electrical coil in a first direction. The method detects unacceptable response variations in the armature to equivalent actuator activation signals. And, subsequent to detection of unacceptable response variations in the armature, current is driven through the electrical coil in a direction opposite that of the first direction following actuator activation signals.

BRIEF DESCRIPTION OF THE DRAWINGS

One or more embodiments will now be described, by way of example, with reference to the accompanying drawings, in which:

FIG. 1-2 illustrates a schematic sectional view of the activation controller of FIG. 1, in accordance of the present disclosure;

FIG. 1-3 illustrates a schematic sectional view of an injector driver of FIGS. 1-1 and 1-2, in accordance to the present disclosure;

FIG. 2 illustrates a plurality of exemplary plots each representing a fuel flow rate for two successive fuel injection events separated by different dwell times, in accordance with the present disclosure;

FIG. 3 illustrates an exemplary first plot 310 representing a measured current and an exemplary second plot 320 representing a measured fuel flow rate for two successive fuel injection events having identical commanded injection durations that are separated by a dwell time that is indicative of being closely-spaced, in accordance with the present disclosure;

DETAILED DESCRIPTION

This disclosure describes the concepts of the presently claimed subject matter with respect to an exemplary application to linear motion fuel injectors. However, the claimed subject matter is more broadly applicable to any linear or non-linear electromagnetic actuator that employs an electrical coil for inducing a magnetic field within a magnetic core resulting in an attractive force acting upon a movable armature. Typical examples include fluid control solenoids, gasoline or diesel or CNG fuel injectors employed on internal combustion engines and non-fluid solenoid actuators for positioning and control.

Figure 1:
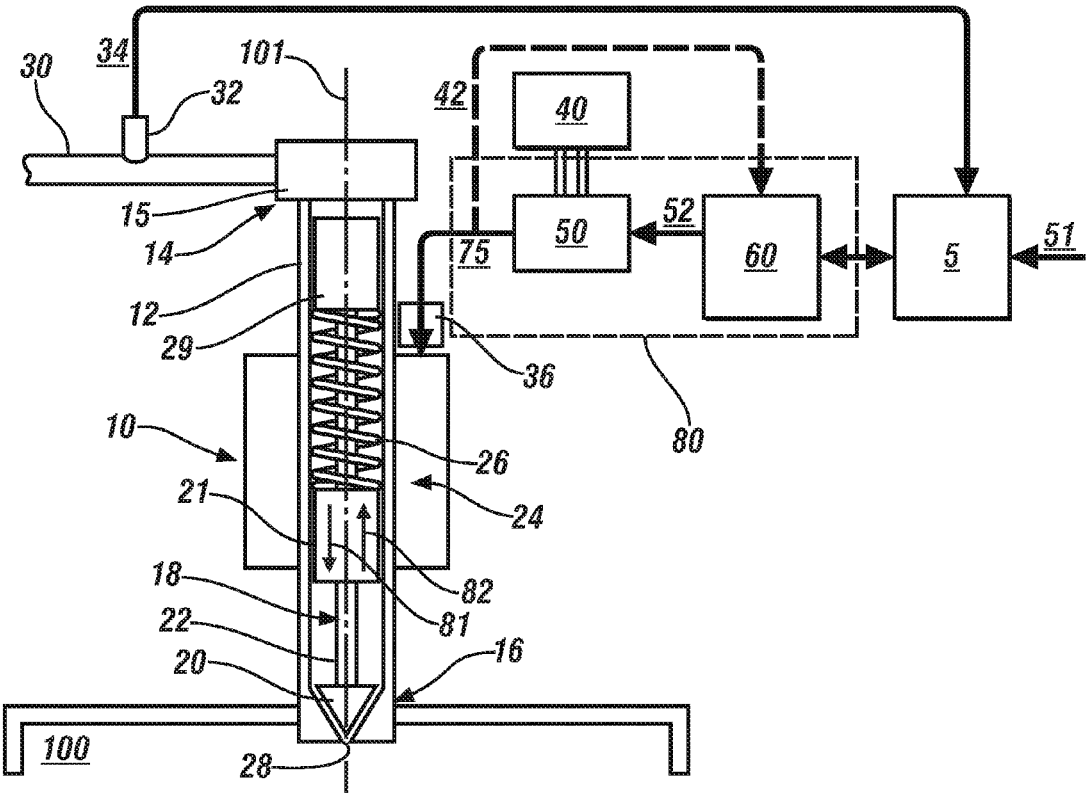
FIG. 1-1 illustrates a schematic sectional view of a fuel injector and an activation controller, in accordance with the present disclosure.

Referring now to the drawings, wherein the showings are for the purpose of illustrating certain exemplary embodiments only and not for the purpose of limiting the same, FIG. 1-1 schematically illustrates a non-limiting exemplary embodiment of an electromagnetically-activated direct-injection fuel injector 10. While an electromagnetically-activated direct-injection fuel injector is depicted in the illustrated embodiment, a port-injection fuel injector is equally applicable. The fuel injector 10 is configured to inject fuel directly into a combustion chamber 100 of an internal combustion engine. An activation controller 80 electrically operatively connects to the fuel injector 10 to control activation thereof. The activation controller 80 corresponds to only the fuel injector 10. In the illustrated embodiment, the activation controller 80 includes a control module 60 and an injector driver 50. The control module 60 electrically operatively connects to the injector driver 50 that electrically operatively connects to the fuel injector 10 to control activation thereof. The fuel injector 10, control module 60 and injector driver 50 may be any suitable devices that are configured to operate as described herein. In the illustrated embodiment, the control module 60 includes a processing device. In one embodiment, one or more components of the activation controller 80 are integrated within a connection assembly 36 of the fuel injector 10. In another embodiment, one or more components of the activation controller 80 are integrated within a body 12 of the fuel injector 10. In even yet another embodiment, one or more components of the activation controller 80 are external to—and in close proximity with—the fuel injector 10 and electrically operatively connected to the connection assembly 36 via one or more cables and/or wires. The terms "cable" and "wire" will be used interchangeably herein to provide transmission of electrical power and/or transmission of electrical signals.

Control module, module, control, controller, control unit, processor and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators. Routines may be executed at regular intervals, for example each 3.125, 6.25, 12.5, 25 and 100 milliseconds during ongoing engine and vehicle operation. Alternatively, routines may be executed in response to occurrence of an event.

In general, an armature is controllable to one of an actuated position and a static or rest position. The fuel injector 10 may be any suitable discrete fuel injection device that is controllable to one of an open (actuated) position and a closed (static or rest) position. In one embodiment, the fuel injector 10 includes a cylindrically-shaped hollow body 12 defining a longitudinal axis 101. A fuel inlet 15 is located at a first end 14 of the body 12 and a fuel nozzle 28 (the fuel nozzle maybe a single opening or multiple holes in the case of a ball shaped valve) is located at a second end 16 of the body 12. The fuel inlet 15 is fluidly coupled to a high-pressure fuel line 30 that fluidly couples to a high-pressure injection pump. A valve assembly 18 is contained in the body 12, and includes a needle valve 20, a spring-activated pintle 22 and an armature portion 21. The needle valve 20 interferingly seats in the fuel nozzle 28 to control fuel flow therethrough. While the illustrated embodiment depicts a triangularly-shaped needle valve 20, other embodiments may utilize a ball. In one embodiment, the armature portion 21 is fixedly coupled to the pintle 22 and configured to linear translate as a unit with the pintle 22 and the needle valve 20 in first and second directions 81, 82, respectively. In another embodiment, the armature portion 21 may be slidably coupled to the pintle 22. For instance, the armature portion 21 may slide in the first direction 81 until being stopped by a pintle stop fixedly attached to the pintle 22. Likewise, the armature portion 21 may slide in the second direction 82 independent of the pintle 22 until contacting a pintle stop fixedly attached to the pintle 22. Upon contact with the pintle stop fixedly attached to the pintle 22, the force of the armature portion 21 causes the pintle 22 to be urged in the second direction 82 with the armature portion 21. The armature portion 21 may include protuberances to engage with various stops within the fuel injector 10.

An annular electromagnet assembly 24, including an electrical coil and magnetic core, is configured to magnetically engage the armature portion 21 of the valve assembly. The electrical coil and magnetic core assembly 24 is depicted for illustration purposes to be outside of the body of the fuel injector; however, embodiments herein are directed toward the electrical coil and magnetic core assembly 24 to be either integral to, or integrated within, the fuel injector 10. The electrical coil is wound onto the magnetic core, and includes terminals for receiving electrical current from the injector driver 50. Hereinafter, the "electrical coil and magnetic core assembly" will simply be referred to as an "electrical coil 24". When the electrical coil 24 is deactivated and de-energized, the spring 26 urges the valve assembly 18 including the needle valve 20 toward the fuel nozzle 28 in the first direction 81 to close the needle valve 20 and prevent fuel flow therethrough. When the electrical coil 24 is activated and energized, electromagnetic force (herein after "magnetic force") acts on the armature portion 21 to overcome the spring force exerted by the spring 26 and urges the valve assembly 18 in the second direction 82, moving the needle valve 20 away from the fuel nozzle 28 and permitting flow of pressurized fuel within the valve assembly 18 to flow through the fuel nozzle 28. The fuel injector 10 may include a stopper 29 that interacts with the valve assembly 18 to stop translation of the valve assembly 18 when it is urged to open. In one embodiment, a pressure sensor 32 is configured to obtain fuel pressure 34 in the high-pressure fuel line 30 proximal to the fuel injector 10, preferably upstream of the fuel injector 10. In another embodiment, a pressure sensor may be integrated within the inlet 15 of the fuel injector in lieu of the pressure sensor 32 in the fuel rail 30 or in combination with the pressure sensor.

The fuel injector 10 in the illustrated embodiment of FIG. 1-1 is not limited to the spatial and geometric arrangement of the features described herein, and may include additional features and/or other spatial and geometric arrangements known in the art for operating the fuel injector 10 between open and closed positions for controlling the delivery of fuel to the engine 100.

The control module 60 generates an injector command (actuator command) signal 52 that controls the injector driver 50, which activates the fuel injector 10 to the open position for affecting a fuel injection event. In the illustrated embodiment, the control module 60 communicates with one or more external control modules such as an engine control module (ECM) 5; however, the control module 60 may be integral to the ECM in other embodiments. The injector command signal 52 correlates to a desired mass of fuel to be delivered by the fuel injector 10 during the fuel injection event. Similarly, the injector command signal 52 may correlate to a desired fuel flow rate to be delivered by the fuel injector 10 during the fuel injection event. As used herein, the term "desired injected fuel mass" refers to the desired mass of fuel to be delivered to the engine by the fuel injector 10. As used herein, the term "desired fuel flow rate" refers to the rate at which fuel is to be delivered to the engine by the fuel injector 10 for achieving the desired mass of fuel. The desired injected fuel mass can be based upon one or more monitored input parameters 51 input to the control module 60 or ECM 5. The one or more monitored input parameters 51 may include, but are not limited to, an operator torque request, manifold absolute pressure (MAP), engine speed, engine temperature, fuel temperature, and ambient temperature obtained by known methods. The injector driver 50 generates an injector activation (actuator activation) signal 75 in response to the injector command signal 52 to activate the fuel injector 10. The injector activation signal 75 controls current flow to the electrical coil 24 to generate electromagnetic force in response to the injector command signal 52. An electric power source 40 provides a source of DC electric power for the injector driver 50. In some embodiments, the DC electric power source provides low voltage, e.g., 12 V, and a boost converter may be utilized to output a high voltage, e.g., 24V to 200 V, that is supplied to the injector driver 50. When activated using the injector activation signal 75, the electromagnetic force generated by the electrical coil 24 urges the armature portion 21 in the second direction 82. When the armature portion 21 is urged in the second direction 82, the valve assembly 18 is consequently caused to urge or translate in the second direction 82 to an open position, allowing pressurized fuel to flow therethrough. The injector driver 50 controls the injector activation signal 75 to the electrical coil 24 by any suitable method, including, e.g., pulsewidth-modulate (PWM) electric power flow. The injector driver 50 is configured to control activation of the fuel injector 10 by generating suitable injector activation signals 75. In embodiments that employ a plurality of successive fuel injection events for a given engine cycle, an injector activation signal 75 that is fixed for each of the fuel injection events within the engine cycle may be generated.

The injector activation signal 75 is characterized by an injection duration and a current waveform that includes an initial peak pull-in current and a secondary hold current. The initial peak pull-in current is characterized by a steady-state ramp up to achieve a peak current, which may be selected as described herein. The initial peak pull-in current generates electromagnetic force that acts on the armature portion 21 of the valve assembly 18 to overcome the spring force and urge the valve assembly 18 in the second direction 82 to the open position, initiating flow of pressurized fuel through the fuel nozzle 28. When the initial peak pull-in current is achieved, the injector driver 50 reduces the current in the electrical coil 24 to the secondary hold current. The secondary hold current is characterized by a somewhat steady-state current that is less than the initial peak pull-in current. The secondary hold current is a current level controlled by the injector driver 50 to maintain the valve assembly 18 in the open position to continue the flow of pressurized fuel through the fuel nozzle 28. The secondary hold current is preferably indicated by a minimum current level. When very small fuel quantities are required, the activation current waveform will not reach its peak and the current hold phase will be omitted in that case. The injector driver 50 is configured as a bi-directional current driver capable of providing a negative current flow for drawing current from the electrical coil 24. As used herein, the term "negative current flow" refers to the direction of the current flow for energizing the electrical coil to be reversed. Accordingly, the terms "negative current flow" and "reverse current flow" are used interchangeably herein.

Embodiments herein are directed toward controlling the fuel injector for a plurality of fuel injection events that are closely-spaced during an engine cycle. As used herein, the term "closely-spaced" refers to a dwell time between each consecutive fuel injection event being less than a predetermined dwell time threshold. As used herein, the term "dwell time" refers to a period of time between an end of injection for the first fuel injection event (actuator event) and a start of injection for a corresponding second fuel injection event (actuator event) of each consecutive pair of fuel injection events. The dwell time threshold can be selected to define a period of time such that dwell times less than the dwell time threshold are indicative of producing instability and/or deviations in the magnitude of injected fuel mass delivered for each of the fuel injection events. The instability and/or deviations in the magnitude of injected fuel mass may be responsive to a presence of secondary magnetic effects. The secondary magnetic effects include persistent eddy currents and magnetic hysteresis within the fuel injector and a residual flux based thereon. The persistent eddy currents and magnetic hysteresis are present due to transitions in initial flux values between the closely-spaced fuel injection events. Accordingly, the dwell time threshold is not defined by any fixed value, and selection thereof may be based upon, but not limited to, fuel temperature, fuel injector temperature, fuel injector type, fuel pressure and fuel properties such as fuel types and fuel blends. As used herein, the term "flux" refers to magnetic flux indicating the total magnetic field generated by the electrical coil 24 and passing through the armature portion. Since the turns of the electrical coil 24 link the magnetic flux in the magnetic core, this flux can therefore be equated from the flux linkage. The flux linkage is based upon the flux density passing through the armature portion, the surface area of the armature portion adjacent to the air gap and the number of turns of the coil 24. Accordingly, the terms "flux", "magnetic flux" and "flux linkage" will be used interchangeably herein unless otherwise stated.

For fuel injection events that are not closely spaced, a fixed current waveform independent of dwell time may be utilized for each fuel injection event because the first fuel injection event of a consecutive pair has little influence on the delivered injected fuel mass of the second fuel injection event of the consecutive pair. However, the first fuel injection event may be prone to influence the delivered injected fuel mass of the second fuel injection event, and/or further subsequent fuel injection events, when the first and second fuel injection events are closely-spaced and a fixed current wave form is utilized. Any time a fuel injection event is influenced by one or more preceding fuel injection events of an engine cycle, the respective delivered injected fuel mass of the corresponding fuel injection event can result in an unacceptable repeatability over the course of a plurality of engine cycles and the consecutive fuel injection events are considered closely-spaced. More generally, any consecutive actuator events wherein residual flux from the preceding actuator event affects performance of the subsequent actuator event relative to a standard, for example relative to performance in the absence of residual flux, are considered closely-spaced.

Exemplary embodiments are further directed toward providing feedback signal(s) 42 from the fuel injector 10 to the activation controller 80. Discussed in greater detail below, sensor devices may be integrated within the fuel injector 10 for measuring various fuel injector parameters for obtaining the flux linkage of the electrical coil 24, voltage of the electrical coil 24 and current through the electrical coil 24. A current sensor may be provided on a current flow path between the activation controller 80 and the fuel injector to measure the current provided to the electrical coil 24, or the current sensor can be integrated within the fuel injector 10 on the current flow path. The fuel injector parameters provided via feedback signal(s) 42 may include the flux linkage, voltage and current directly measured by corresponding sensor devices integrated within the fuel injector 10. Additionally or alternatively, the fuel injector parameters may include proxies provided via feedback signal(s) 42 to—and used by—the control module 60 to estimate the flux linkage, magnetic flux, the voltage, and the current within the fuel injector 10. Having feedback of the flux linkage of the electrical coil 24, the voltage of the electrical coil 24 and current provided to the electrical coil 24, the control module 60 may advantageously modify the activation signal 75 to the fuel injector 10 for multiple consecutive injection events. It will be understood that conventional fuel injectors controlled by open loop operation, are based solely upon a desired current waveform obtained from look-up tables, without any information related to the force producing component of the flux linkage (e.g., magnetic flux) affecting movement of the armature portion 21. As a result, conventional feed-forward fuel injectors that only account for current flow for controlling the fuel injector may be susceptible to instability in consecutive fuel injection events that are closely-spaced.

It is known when the injector driver 50 only provides current uni-directionally in a positive first direction to energize the electrical coil 24, releasing the current to remain stable at zero will result in the magnetic flux within the fuel injector to gradually decay, e.g., taper off, towards zero. However, the response time for the magnetic flux to decay is slow, and the presence of magnetic hysteresis within the fuel injector often results in the presence of residual flux when a subsequent closely-spaced fuel injection event is initiated. As aforementioned, the presence of the residual flux impacts the accuracy of the fuel flow rate and injected fuel mass to be delivered in a subsequent closely-spaced fuel injection event.

Figures 1, 2:
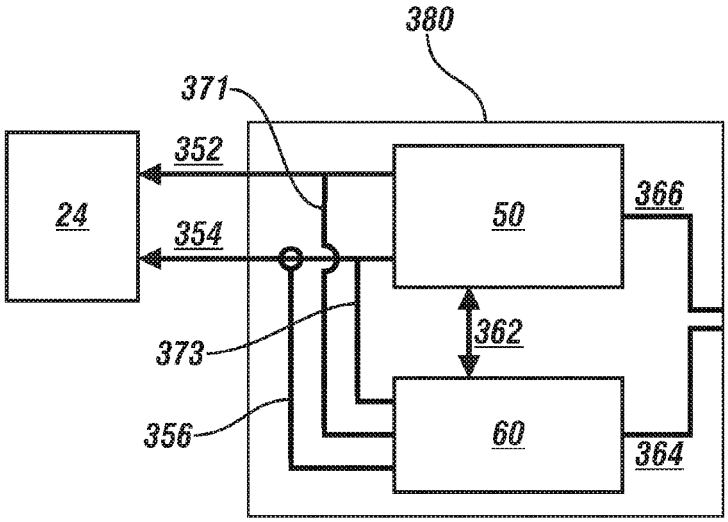

FIG. 1-2 illustrates the activation controller 80 of FIG. 1-1. Signal flow path 362 provides communication between the control module 60 and the injector driver 50. For instance, signal flow path 362 provides the injector command signal (e.g., command signal 52 of FIG. 1-1) that controls the injector driver 50. The control module 60 further communicates with the external ECM 5 via signal flow path 364 within the activation controller 380 that is in electrical communication with a power transmission cable. For instance, signal flow path 364 may provide monitored input parameters (e.g., monitored input parameters 51 of FIG. 1-1) from the ECM 5 to the control module 60 for generating the injector command signal 52. In some embodiments, the signal flow path 364 may provide feedback fuel injector parameters (e.g., feedback signal(s) 42 of FIG. 1-1) to the ECM 5.

The injector driver 50 receives DC electric power from the power source 40 of FIG. 1-1 via a power supply flow path 366. The signal flow path 364 can be eliminated by use of a small modulation signal added to the power supply flow path 366. Using the received DC electric power, the injector driver 50 may generate injector activation signals (e.g., injector activation signals 75 of FIG. 1-1) based on the injector command signal from the control module 60.

The injector driver 50 is configured to control activation of the fuel injector 10 by generating suitable injector activation signals 75. The injector driver 50 is a bi-directional current driver providing positive current flow via a first current flow path 352 and negative current flow via a second current flow path 354 to the electrical coil 24 in response to respective injector activation signals 75. The positive current via the first current flow path 352 is provided to energize an electrical coil 24 and the negative current via the second current flow path 354 reverses current flow to draw current from the electrical coil 24. Current flow paths 352 and 354 form a closed loop; that is, a positive current into 352 results in an equal and opposite (negative) current in flow path 354, and vice versa. Signal flow path 371 can provide a voltage of the first current flow path 352 to the control module 60 and signal flow path 373 can provide a voltage of the second current flow path 354 to the control module 60. The voltage and current applied to the electrical coil 24 is based on a difference between the voltages at the signal flow paths 371 and 373. In one embodiment, the injector driver 50 utilizes open loop operation to control activation of the fuel injector 10, wherein the injector activation signals are characterized by precise predetermined current waveforms. In another embodiment, the injector driver 50 utilizes closed loop operation to control activation of the fuel injector 10, wherein the injector activation signals are based upon fuel injector parameters provided as feedback to the control module, via the signal flow paths 371 and 373. A measured current flow to the coil 24 can be provided to the control module 60, via signal flow path 356. In the illustrated embodiment, the current flow is measured by a current sensor on the second current flow path 354. The fuel injector parameters may include flux linkage, voltage and current values within the fuel injector 10 or the fuel injector parameters may include proxies used by the control module 60 to estimate flux linkage, voltage and current within the fuel injector 10.

Figures 1, 2, 3:
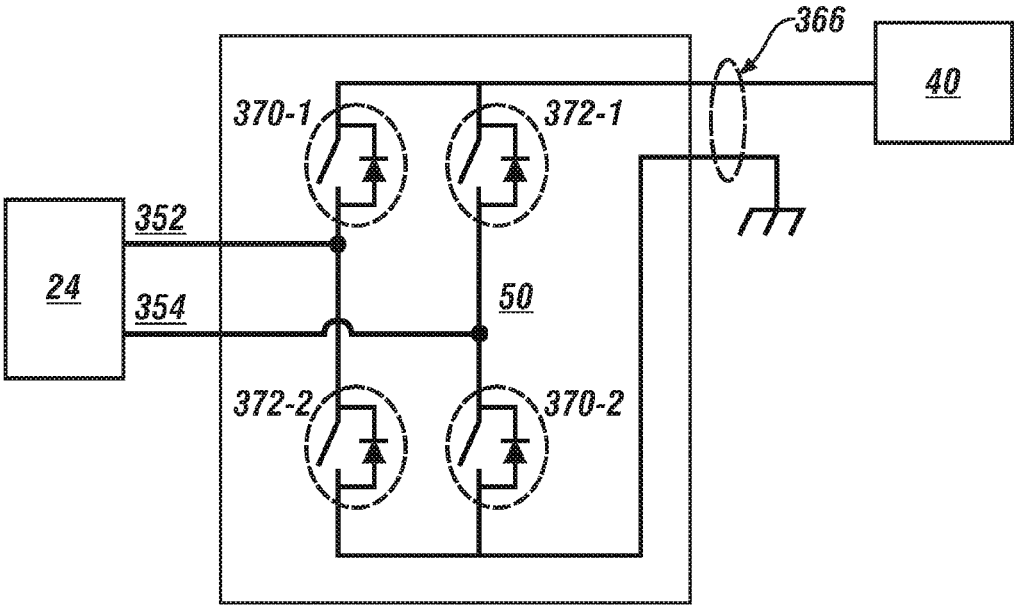

In some embodiments, the injector driver 50 is configured for full four quadrant operation. FIG. 1-3 illustrates an exemplary embodiment of the injector driver 50 of FIGS. 1-2 utilizing two switch sets 370 and 372 to control the current flow provided between the injector driver 50 and the electrical coil 24. In the illustrated embodiment, the first switch set 370 includes switch devices 370-1 and 370-2 and the second switch set 372 includes switch devices 372-1 and 372-2. The switch devices 370-1, 370-2, 372-1, 372-2 can be solid state switches and may include Silicon (Si) or wide band gap (WBG) semiconductor switches enabling high speed switching at high temperatures. The four quadrant operation of the injector driver 50 controls the direction of current flow into and out of the electrical coil 24 based upon a corresponding switch state determined by the control module 60. The control module 60 may determine a positive switch state, a negative switch state and a zero switch state and command the first and second switch sets 370 and 372 between open and closed positions based on the determined switch state. In the positive switch state, the switch devices 370-1 and 370-2 of the first switch set 370 are commanded to the closed position and the switch devices 372-1 and 372-2 of the second switch set 372 are commanded to the open position to control positive current into the first current flow path 352 and out of the second current flow path 354. These switch devices may be further modulated using pulse width modulation to control the amplitude of the current. In the negative switch state, the switch devices 370-1 and 370-2 of the first switch set 370 are commanded to the open position and the switch devices 372-1 and 372-2 of the second switch set 372 are commanded to the closed position to control negative current into the second current flow path 354 and out of the first current flow path 352. These switch devices may be further modulated using pulse width modulation to control the amplitude of the current. In the zero switch state, all the switch devices 370-1, 370-2, 372-1, 372-2 are commanded to the open position to control no current into or out of the electromagnetic assembly. Thus, bi-directional control of current through the coil 24 may be effected.

In some embodiments, the negative current for drawing current from the electrical coil 24 is applied for a sufficient duration for reducing residual flux within the fuel injector 10 after current is released. In other embodiments, the negative current is applied subsequent to release of the current but additionally only after the fuel injector has closed or actuator has returned to its static or rest position. Moreover, additional embodiments can include the switch sets 370 and 372 to be alternately switched between open and closed positions to alternate the direction of the current flow to the coil 24, including pulse width modulation control to effect current flow profiles. The utilization of two switch sets 370 and 372 allows for precise control of current flow direction and amplitude applied to the current flow paths 352 and 354 of the electrical coil 24 for multiple consecutive fuel injection events during an engine event by reducing the presence of eddy currents and magnetic hysteresis within the electrical coil 24.

FIG. 2 illustrates a plurality of non-limiting exemplary plots each representing a measured fuel flow rate for two successive fuel injection events separated by different dwell times. In the illustrated non-limiting plots, each fuel injection event is characterized by an identical commanded injection duration for delivering an identical desired injected fuel mass; however, each fuel injection event may be characterized by a respective commanded injection duration for delivering a respective desired injected fuel mass that is different from the other fuel injection events. In the illustrated embodiment, the commanded injection duration is 265 microseconds. The horizontal x-axis in each of plots 210-240 denotes time in milliseconds (ms) and the vertical y-axis denotes fuel flow rate in milligrams (mg) per milliseconds (ms). Each plot includes a corresponding one of a plurality of measured fuel flow rate profile lines 212, 222, 232 and 242, whereat each measured fuel flow rate profile line represents a measured fuel flow rate for the two successive fuel injection events during a respective engine cycle. It will be recognized that the fuel flow rate profile lines 212, 222, 232 and 242 can be integrated to determine a corresponding injected fuel mass delivered. The first fuel injection event includes a start of injection at about 0.25 ms and an end of injection of about of about 0.60 ms for each of the plots 210-240.

Referring to plot 210, the plurality of measured fuel flow rate profile lines 212 each corresponding to the respective engine cycle are illustrated for the two fuel injection events. A start of injection and an end of injection for the second fuel injection event occurs at about 3.5 ms and 3.8 ms, respectively. A dwell time representing a period of time separating the first and second fuel injection events is about 3.0 ms.

Referring to plot 220, the plurality of measured fuel flow rate profile lines 222 each corresponding to the respective engine cycle are illustrated for the two fuel injection events. A start of injection and an end of injection for the second fuel injection event occurs at about 2.5 ms and 2.8 ms, respectively. A dwell time representing a period of time separating the first and second fuel injection events is about 2.0 ms.

In each of the non-limiting exemplary plots 210 and 220, the corresponding dwell times of 3.0 ms and 2.0 ms separating the first and second fuel injection events exceed a dwell time threshold. Thus, the first and second fuel injection events in each of plots 210 and 220 are not indicative of being closely-spaced, and secondary magnetic effects present within the fuel injector are permitted to decay toward zero or otherwise some non-influencing value, before a subsequent fuel injection event begins. As a result, the plurality of measured fuel flow rate profile lines 212 and 220 are substantially identical for each of the fuel injection events. Desirably, an injected fuel mass delivered at the second fuel injection event will be the same as an injected fuel mass delivered at the first fuel injection event.

Referring to plot 230, the plurality of fuel flow rate profile lines 232 each corresponding to the respective engine cycle are illustrated for the two fuel injection events. A start of injection for the second fuel injection event occurs around the range 1.4-1.6 ms and an end of injection for the second fuel injection event occurs around the range of 1.7-1.9 ms. A dwell time representing a period of time separating the first and second fuel injection events is about 1.0 ms. In the illustrated non-limiting exemplary plot 230, the dwell time of about 1.0 ms is less than the dwell time threshold. Thus, the first and second fuel injection events are indicative of being closely-spaced. While the commanded injection duration is identical for the first and second fuel injection events during each respective engine cycle, the plurality of measured fuel flow rate profile lines 232 indicate a deviation in the measured fuel flow rate for the second fuel injection event between each of the engine cycles. This deviation in the measured fuel flow rate for the second fuel injection event between each of the engine cycles is due to the two fuel injection events being closely-spaced. Accordingly, this instability of the second fuel injection event between the engine cycles undesirably results in the injected fuel mass delivered at the second fuel injection event to deviate from a desired injected fuel mass from engine cycle to engine cycle. The plurality of measured fuel flow rate profile lines 232 in the non-limiting exemplary plot 230 indicates that the injected fuel mass delivered at the second fuel injection event for each of the engine cycles may deviate by as much as 2.9 mg from one another around the desired injected fuel mass of 4.0 mg. It will be appreciated that the non-limiting exemplary plot 230 is only exemplary to depict instability in the second fuel injection event due to a dwell time separating the consecutive fuel injection events indicative of being closely-spaced. It will be understood that another injector with the same dwell time (e.g., 1.0 ms) separating the two fuel injection events and the same commanded injection duration (e.g., 265 microseconds) may exhibit satisfactory stability in the second fuel injection event during each engine cycle, but the injected fuel mass at the second fuel injection event may undesirably deviate from the desired injected fuel mass to be delivered. It may even be possible that another fuel injector with the same dwell time (e.g., 1.0 ms) separating the two fuel injection events and the same commanded injection duration (e.g., 265 microseconds) result in both fuel injection events having equal injected fuel masses delivered. Thus, dwell times separating consecutive fuel injection events that are closely-spaced result in erratic delivery of the injected fuel mass being delivered that can change from injector to injector.

Referring to plot 240, the plurality of fuel flow rate profile lines 242 each corresponding to the respective engine cycle are illustrated for the two fuel injection events. A start of injection and an end of injection for the second fuel injection event occurs at about 0.8 ms and 1.4 ms, respectively. A dwell time representing a period of time separating the first and second fuel injection events is about 0.5 ms. In the illustrated non-limiting exemplary plot 240, the dwell time of about 0.5 ms is less than the dwell time threshold. Thus, the first and second fuel injection events are indicative of being closely-spaced. While the commanded injection duration is identical for the first and second fuel injection events during each respective engine cycle, the plurality of measured fuel flow rate profile lines 242 indicate a variation in the measured fuel flow rate between each of the first and second fuel injection events. Specifically, the measured fuel flow rate for the second fuel injection event occurs over a longer duration than the first fuel injection event, resulting in a magnitude of the injected fuel mass at the second fuel injection event to be greater than the desired injected fuel mass (e.g., 4.0 mg) to be delivered and closely achieved by the first fuel injection event. It will be appreciated that the dwell time of 0.5 ms separating the first and second fuel injection events in plot 240 depicts a relatively stable second fuel injection event compared to the unstable second fuel injection event described above with reference to plot 230 when the dwell time of 1.0 ms separated the first and second fuel injection events. It will be understood that another injector with the same dwell time (e.g., 0.5 ms) separating the two fuel injection events and the same commanded injection duration (e.g., 265 microseconds) may exhibit instability in the second fuel injection event during each engine cycle.

FIG. 3 illustrates a non-limiting first plot 310 representing a measured current and a non-limiting second plot 320 representing a measured fuel flow rate for two successive fuel injection events having identical commanded injection durations that are separated by a dwell time that is indicative of being closely-spaced. The horizontal x-axis in each plot 310 and 320 denotes time in milliseconds (ms). The vertical y-axis denotes current in Amperage (A). It will be understood that while only two successive fuel injection events are depicted in the illustrated embodiment, embodiments herein are equally applicable to three or more successive fuel injection events each separated by dwell times that are indicative of being closely-spaced.

Referring to the first plot 310, a plurality of measured current profile lines 312 each corresponding to a respective engine cycle for the two fuel injection events are illustrated. Each measured current profile line indicates a measured uni-directional electrical current energizing the electrical coil of the fuel injector 10 of FIG. 1-1 (i.e. injector activation signal) to achieve a desired injected fuel mass to be delivered. While the illustrated embodiment indicates that each of the first and second fuel injection events are configured to achieve an identical desired injected fuel mass (e.g., 4 mg), other embodiments may include each fuel injection event configured to achieve a different desired injected fuel mass.

Referring to the second plot 320, a plurality of measured fuel flow rate profile lines 322 each corresponding to the respective engine cycle for the two fuel injection events are illustrated. A dwell time representing a period of time separating the first and second fuel injection events is about 0.6 ms and is less than the dwell time threshold. While the commanded injection duration is identical for the first and second fuel injection events during each respective engine cycle, the plurality of measured fuel flow rate profile lines 322 indicate a deviation in the measured fuel flow rate for the second fuel injection event between each of the engine cycles. As described above with reference to the non-limiting exemplary plot 230 of FIG. 2, this instability of the second fuel injection event between engine cycles undesirably results in the injected fuel mass delivered at the second fuel injection event to be inconsistently delivered. In the illustrated embodiment, the injected fuel mass delivered at the second fuel injection event between each of the engine cycles may deviate by as much as 2.9 mg from one another around a desired injected fuel mass of about 4.0 mg/ms.

A start of injection (SOI) time and an end of injection (EOI) time can each be sensed based upon discernible changes in monitored parameters of the fuel injection. The SOI time is indicative of a time point whereat the injector begins to open for delivering fuel. The SOI time can interchangeably be referred to as an actual injector opening time. In some embodiments, the SOI time corresponds to a time point indicating a discernible decrease in the fuel pressure 34 proximal to the fuel injector. However, this disclosure is not limited to any one method for determining the SOI time, and any method can be utilized to obtain the SOI time such as by referencing residual voltage. As aforementioned, fuel pressure can be measured by the fuel sensor 32 at the fuel rail 30 of FIG. 1-1 or fuel pressure can be measured by a fuel sensor located within the inlet 15 of the fuel injector 10. The EOI time is indicative of a time point whereat the injector is closed and the delivery of fuel is stopped. The EOI time can interchangeably be referred to as an actual injector closing time. The EOI time corresponds to a time point indicating a discernible residual voltage inflection point in voltage across the electrical coil 24. As used herein, the term "EOI time corresponds to a time point" refers to a correlation between the EOI time and the residual voltage inflection point, wherein the EOI time and the residual voltage inflection point are not necessarily coincident with one another. The voltage across the electrical coil 24 may be obtained by a corresponding sensor integrated within the fuel injector and provided to the control module 60 via the feedback signal(s) 42. Likewise, obtained fuel injector parameters may include proxies provided via the feedback signal(s) 42 to—and used by—the control module 60 to estimate the voltage within the fuel injector 10 (e.g., across the electrical coil 24). Accordingly, the control module 60 can determine discernible residual voltage inflection point based upon the obtained voltage across the electrical coil 24.

Embodiments herein are directed toward using the discernible residual voltage inflection point for determining stability in a fuel injection event between engine cycles as well as the EOI time of the fuel injection event. A fuel injection event can be indicative of being stable if the residual voltage inflection point repeatedly occurs at or around a same time point in each engine cycle. However, a fuel injection event can be indicative of being unstable if the residual voltage inflection point occurs at non-repeating, or otherwise inconsistent, time points between each engine cycle. In other words a variable residual voltage inflection point indicating that the residual voltage inflection point varies from engine cycle to engine cycle can indicate that the corresponding fuel injection event is unstable. Unstable fuel injection events undesirably result in deviations from a desired injected fuel mass to be delivered at the fuel injection event during the engine cycles. Generally, when a plurality of fuel injection events during each of a plurality of engine cycles are indicative of being closely-spaced, one or more fuel injection events subsequent to the first fuel injection event can result in deviations from a desired injected fuel mass, as described above with reference to the non-limiting exemplary plot 320 of FIG. 3. Additionally, the EOI time determined from the residual voltage inflection point and the obtained SOI time determined from the discernible change in fuel pressure or other method, can be utilized to calculate the actual injector duration such that the injected fuel mass actually delivered can be estimated.

Figure 4:
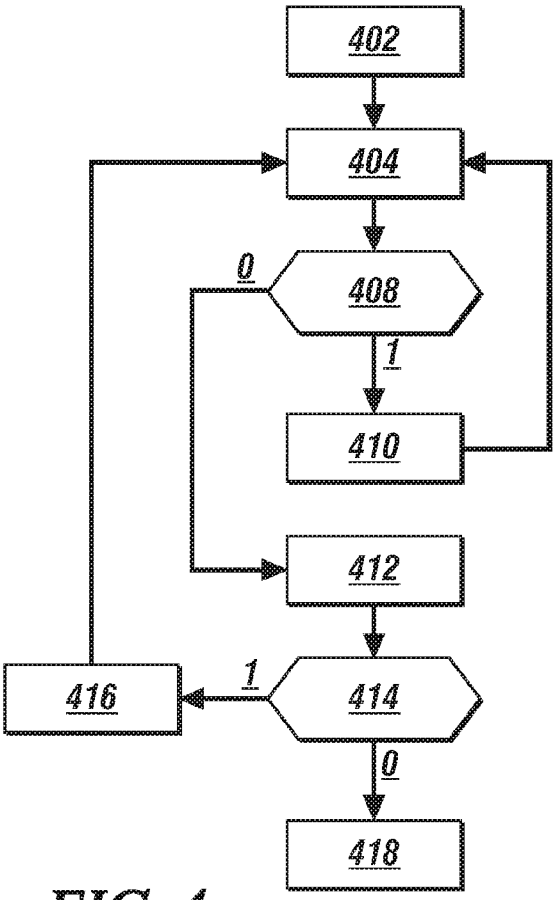
FIG. 4 illustrates an exemplary flowchart 400 for improving performance of a fuel injector implementing a plurality of closely-spaced consecutive fuel injection events during each of a plurality of engine cycles, in accordance with the present disclosure.
Figure 2:
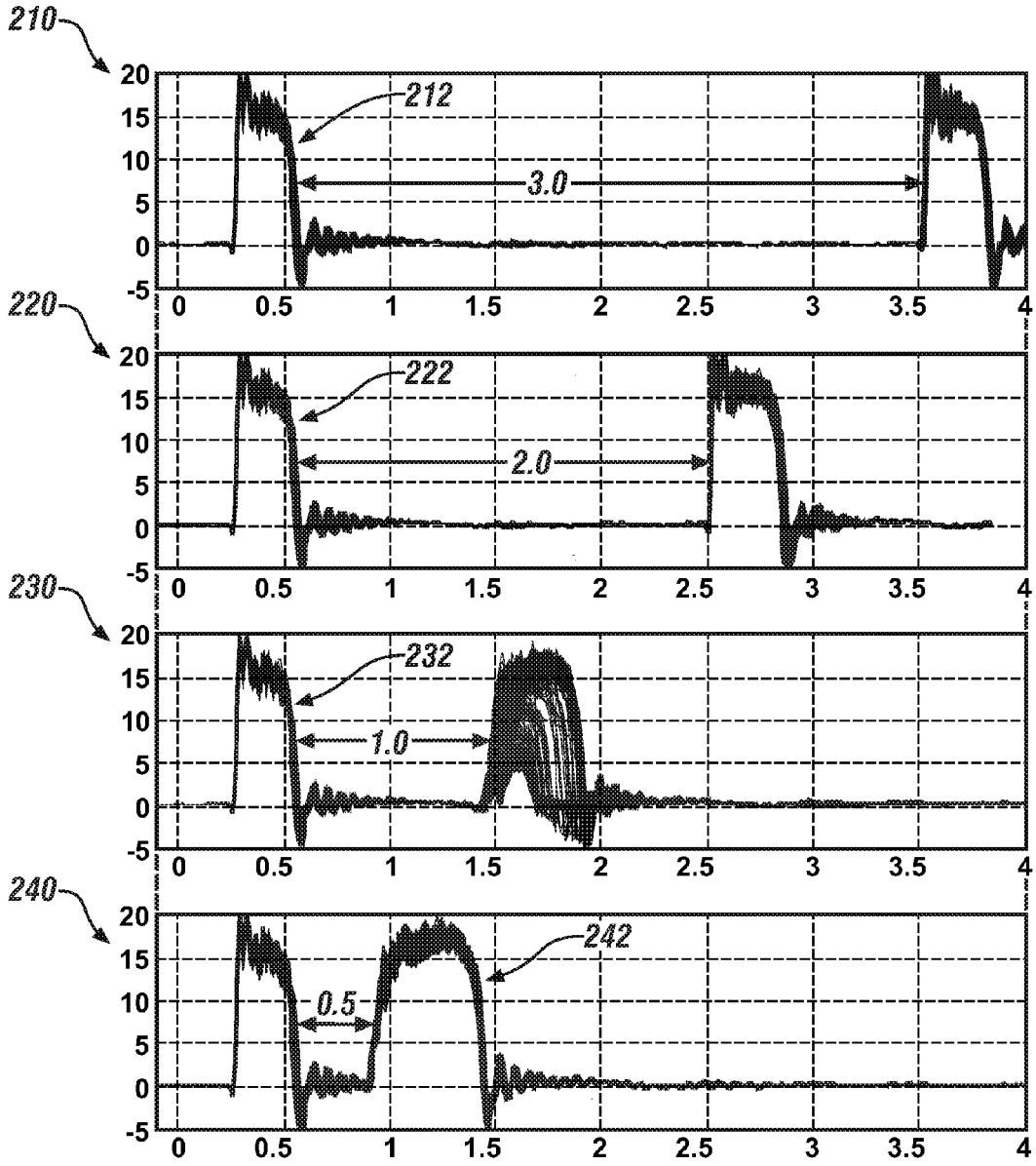
Figure 3:
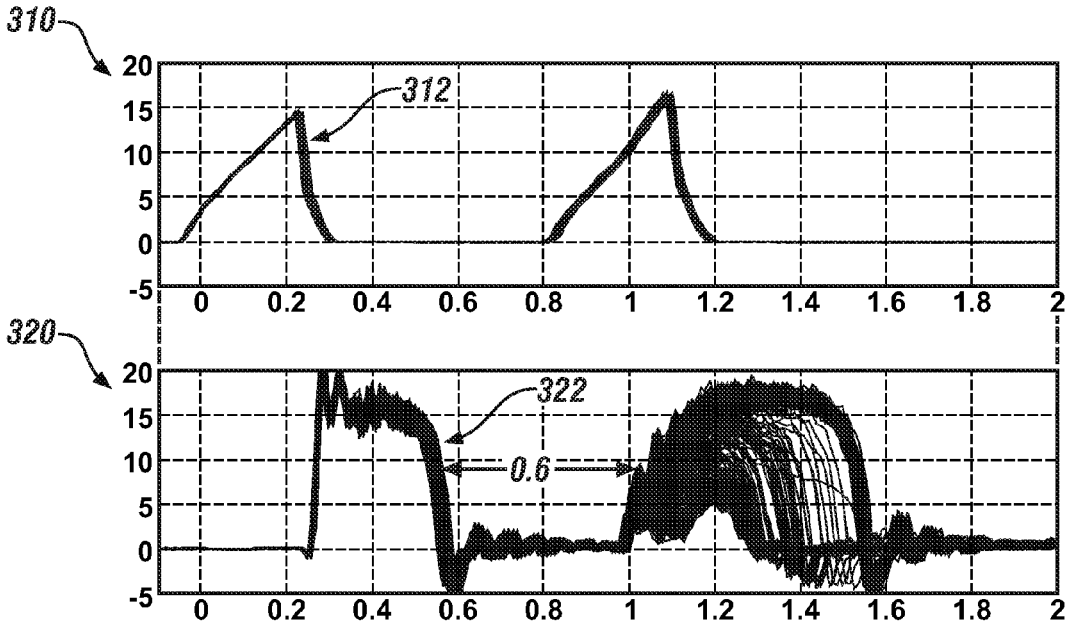

FIG. 4 illustrates an exemplary flowchart 400 for improving performance of a fuel injector implementing a plurality of closely-spaced consecutive fuel injection events during each of a plurality of engine cycles. For simplicity, the exemplary flowchart 400 will be described with reference to two closely-spaced consecutive fuel injection events; however, the flowchart 400 can equally be applied for improving performance of three or more closely-spaced consecutive fuel injection events. The exemplary flowchart 400 can be described with reference to the fuel injector 10 and activation controller 80 of FIG. 1-1. The exemplary flowchart 400 can be implemented within—and executed by—any combination of the control module 50 and the external ECM 5 of FIG. 1-1. Table 1 is provided as a key to FIG. 4 wherein the numerically labeled blocks and the corresponding functions are set forth as follows.

TABLE 1

| BLOCK | BLOCK CONTENTS |
|---|---|
| 402 | Start. |
| 404 | Obtain a residual voltage inflection point across the electrical coil 24 for each of a plurality of closely-spaced consecutive fuel injection events. |
| 408 | Is at least one fuel injection event indicative of being unstable based on the residual voltage inflection point? |
| 410 | Apply a reversed current flow in increments after a commanded injector closing time for fuel injection events until all the fuel injection events are indicative of being stable. |
| 412 | Determine the injected fuel mass delivered at each fuel injection event based on the residual voltage inflection point. |
| 414 | Does the injected fuel mass delivered at any one of the fuel injection events deviate from a corresponding desired injected fuel mass? |
| 416 | Adjust injector duration of one or more fuel injection events such that a corresponding desired injected fuel mass is achieved at each fuel injection event. |
| 418 | Employ adaptive learning for the fuel injector. |

The flowchart 400 starts at block 402 and proceeds to block 404 whereat the residual voltage inflection point across the electrical coil 24 is obtained for each of the fuel injection events. It will be appreciated that blocks 402-404 can be iteratively executed over a prescribed number of engine cycles.

Decision block 408 determines if at least one fuel injection event is indicative of being unstable based on the residual voltage inflection point during the prescribed number of engine cycles. A "0" indicates that all of the fuel injection events are stable, and the flowchart 400 proceeds to block 412. A "1" indicates that at least one of the fuel injection events is indicative of being unstable, and the flowchart 400 proceeds to block 410. It will be appreciated that the first fuel injection event is always likely to be indicative of being stable; however, any subsequently occurring fuel injection event can result in instability due to the enhanced presence of secondary magnetic effects, such as residual flux, caused by persistent eddy currents from preceding closely-spaced fuel injection events. As aforementioned, a fuel injection event is indicative of being unstable when the corresponding residual voltage inflection point varies between engine cycles. For instance, if the residual voltage inflection point for a corresponding fuel injection event includes a point in time between engine cycles that changes by a magnitude exceeding a time threshold, the fuel injection event can be indicative of being unstable. In some embodiments, the time point at which the residual voltage inflection point occurs can be compared to a desired time point corresponding to a desired injector closing time. If the residual voltage inflection point deviates from the desired time point by a magnitude exceeding an inflection time threshold during a corresponding engine cycle, the residual voltage inflection point can be deemed variable during the corresponding engine cycle. If the residual voltage inflection point is deemed variable for a number of engine cycles that exceeds a threshold, the corresponding fuel injection can be indicative of being unstable. In yet another embodiment, the injected fuel mass actually delivered at each fuel injection event could be determined and utilized for determining instability in one or more of the fuel injection events. Here, if the injected fuel masses during the plurality of engine cycles include a standard deviation from one another that exceeds a predetermined deviation threshold, the fuel injection event can be indicative of being unstable between the engine cycles. For instance, and with reference to the non-limiting exemplary plot 320 of FIG. 3, the injected fuel masses delivered at the second fuel injection event during the plurality of engine cycles includes a standard deviation from one another that exceeds the predetermined deviation threshold.

At block 410, a reversed current is applied, preferably in increments as required, after a commanded injector closing time for each of the fuel injection events until each of the fuel injection events are indicative of being stable. As used herein, the term "applied in increments" and similar, refers to a negative peak magnitude of the reversed current flow being increased by an increment (whether equivalent or variable) for each subsequent engine cycle. Hence, block 410 will apply the reverse current by an increment during an instant engine cycle and revert back to block 404 for an immediately subsequent engine cycle. If decision block 408 is a "1", indicating that at least one of the fuel injection events of the immediately subsequent engine cycle is indicative of being unstable, block 410 will increase the increment of the reverse current applied for the immediately subsequent (e.g., now instant) engine cycle. Embodiments can include the increment by which the negative peak magnitude increases to be fixed or variable from engine cycle to engine cycle. It will be appreciated that the negative peak magnitude of the reversed current flow applied can be the same or different for each fuel injection event during each engine cycle. As will be described in further detail below with reference to exemplary non-limiting plots 510 and 520 of FIG. 5, electrical currents are applied bi-directionally through the electrical coil 24, whereat electrical current flow in a positive direction is utilized to energize the electrical coil 24 for opening the fuel injector and the reversed current flow in a negative direction is applied to the electrical coil 24 to reduce the presence of residual flux within the fuel injector after the injector has been commanded to close and the electrical current in the positive current is released to zero.

Block 412 determines the injected fuel mass delivered at each fuel injection event based on the residual voltage inflection point obtained at block 404 after application of the reverse current flow to stabilize each of the fuel injection events. Here, the residual voltage inflection point can correspond to a time point indicating the EOI time. The SOI time can be obtained using any known method, such as, by identifying a discernible pressure decrease. The actual injection duration for each fuel injection event can be determined based on the difference between the SOI and EOI times. When the actual injector duration is determined, the actual injected fuel mass delivered at each fuel injection event can be determined. It will be appreciated that fuel injection events indicative of being stable represent precision in the delivery of the injected fuel masses, but stability does not equate to the delivery of each the injected fuel masses to be accurate, e.g., achieve the corresponding desired injected fuel masses.

The flowchart 400 then proceeds to decision block 414 whereat it is determined if the injected fuel mass delivered at any one of the fuel injection events deviates from a corresponding desired injected fuel mass. It will be understood that the application of the reverse current will affect the corresponding fuel injection event at which it is applied, as well as one or more subsequent fuel injection events. In some embodiments, the injected fuel mass deviates from the corresponding injected fuel mass when the difference between the actual and the desired injected fuel masses includes a magnitude that exceeds a deviation threshold. For instance, the injected fuel mass may be permitted to vary to some degree with respect to the desired injected fuel mass. Generally, application of the reversed current flow in the negative direction to the electrical coil 24 at block 410 rapidly reduces the presence of the aforementioned secondary magnetic affects within the fuel injector, thereby increasing the response time of the fuel injector to result in faster closing times that decrease the injected fuel mass actually delivered. A "1" indicates that the injected fuel mass delivered at one or more of the fuel injection events deviates from the corresponding desired injected fuel mass, and the flowchart 400 proceeds to block 416. Non-limiting plot 520 of FIG. 5 described in greater detail below, illustrates deviation in the first fuel injection event as a result of a faster closing time due to a reverse current flow applied in increments. A "0" indicates that each fuel injection events does not deviate from the corresponding desired injected fuel mass, and the flowchart proceeds to block 418.

At block 416, an injection duration of one or more fuel injection events is adjusted such that the corresponding desired injected fuel mass is achieved at each fuel injection event. Specifically, the injection durations for one or more of the fuel injection events can be adjusted to compensate for the deviations from the corresponding desired injected fuel mass, as determined when decision block 414 is a "1". The durations in one or more of the fuel injection events can be adjusted to affect changes in the injected fuel mass actually delivered at one or more of the fuel injection events. This disclosure is not limited to any one strategy for adjusting the injection durations for one or more fuel injection events, and therefore, any strategy for adjusting injection duration can be utilized to achieve the corresponding desired injected fuel mass at each fuel injection event. The flow chart 400 then reverts back to block 404 and repeats blocks 404-414.

At block 418, adaptive learning is employed whereat results carried out during blocks 404-416 of the exemplary flowchart 400 are stored within one or more non-volatile memory devices corresponding to the control module 60 and/or the ECM 5. The memory devices can store results for each of a plurality of fuel injectors employed by the engine. During subsequent engine cycles, the control module 60 may retrieve the results from within the memory to efficiently operate fuel injector on an individual basis and make appropriate adjustments as needed. In one embodiment, when the activation controller 80 commands a current waveform and commands an injection duration to achieve a desired injected fuel mass, the control module 60 may retrieve results obtained from a corresponding current waveform and injection duration stored within the memory devices that was utilized to achieve the same desired injected fuel mass. For instance, a reversed current flow can be applied simultaneously in response to the commanded current waveform and injection duration. Moreover, the appropriate negative peak amplitude when the reverse current is applied can be obtained quickly without having to go through a plurality of increments. Additionally, the adaptive learning allows for results to be dynamically updated to compensate for fuel injector aging and further diagnosing faults and taking appropriate remedial actions.

Figure 5:
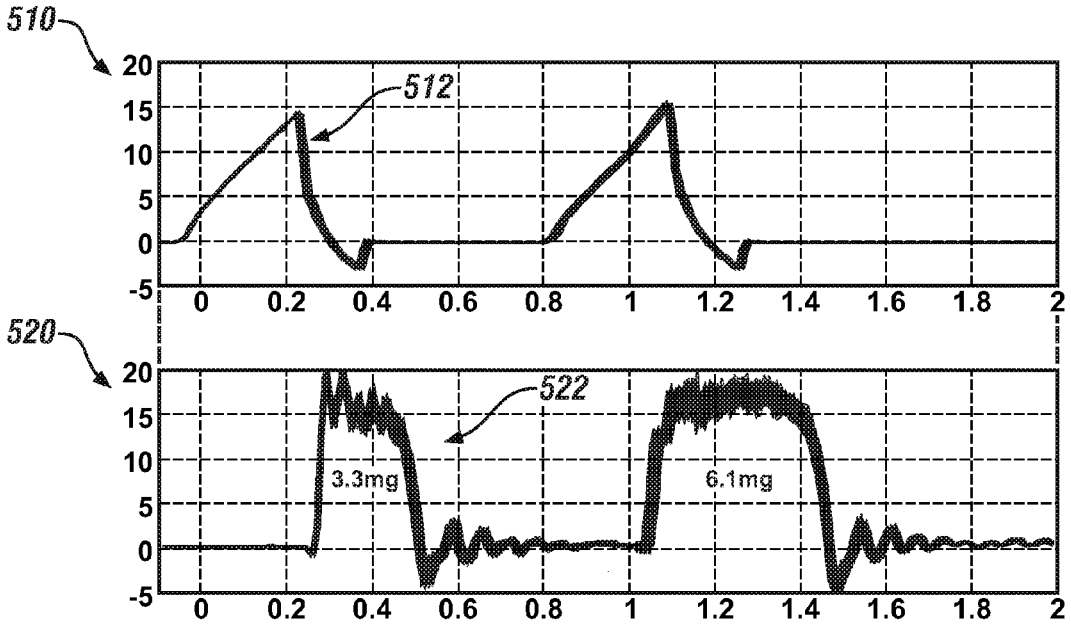
FIG. 5 illustrates an exemplary first plot 510 representing a measured current and a non-limiting exemplary second plot 520 representing a measured fuel flow rate for two successive fuel injection events each characterized by bi-directional current waveforms having identical commanded injection durations, in accordance with the present disclosure.

FIG. 5 illustrates a non-limiting first plot 510 representing a measured current and a non-limiting second plot 520 representing a measured fuel flow rate for two successive fuel injection events each characterized by bi-directional current waveforms having identical commanded injection durations. The horizontal x-axis in each plot 510 and 520 denotes time in milliseconds (ms).

Referring to the first plot 510, measured current profile lines 512 each correspond to a respective engine cycle for the two fuel injection events are illustrated. The vertical y-axis denotes current in Amperage (A). Each measured current profile line 512 indicates a measured bi-directional electrical current through the electrical coil 24 (i.e. injector activation signal), whereat electrical current flow in a positive direction is utilized (e.g., from about 0 ms to about 0.3 ms for the first fuel injection event and from about 0.8 ms to about 1.1 ms for the second fuel injection event) to energize the electrical coil 24 for opening the fuel injector and a reversed current flow in a negative direction is applied to the electrical coil 24 (e.g., from about 0.3 ms to about 0.4 ms for the first fuel injection event and from about 1.1 ms to about 1.3 ms for the second fuel injection event) to reduce the presence of residual flux within the fuel injector after the injector has been commanded to close and the electrical current in the positive current is released to zero. The bi-directional electrical current is incrementally applied through the electrical coil when one or more of the fuel injection events are indicative of being unstable, as described above with reference to decision block 408 of the exemplary flowchart 400 of FIG. 4 and the non-limiting exemplary plot 320 of FIG. 3.

Referring to the second plot 520, a plurality of measured fuel flow rate profile lines 522 each corresponding to the respective engine cycle for the two fuel injection events are illustrated. The vertical y-axis denotes fuel flow rate in milligrams (mg) per millisecond (ms). The plurality of measured fuel flow rate profile lines 522 indicate that the first and second fuel injection events are indicative of being stable. Hence, the reverse current flow applied in increments to obtain an appropriate negative peak magnitude is effective to compensate for the deviation in the measured fuel flow rate 322 for the second fuel injection event illustrated in non-limiting plot 320 of FIG. 3 between each of the engine cycles. However, while application of the reversed current flow in the negative direction to the electrical coil 24 is effective to stabilize the injected fuel mass at the second fuel injection event between each of the injection cycles by rapidly reducing the presence of the aforementioned secondary magnetic affects within the fuel injector, the response time of the fuel injector is consequently increased. The increased response time of the fuel injector results in faster closing times that decrease the injected fuel mass actually delivered as depicted by the measured fuel flow rate profile 522 at the first fuel injection event. Accordingly, block 412 of the exemplary flowchart 400 indicates that the injected fuel mass delivered at each of the first and second fuel injection events is about 3.3 mg and 6.1 mg, respectively, as indicated by the fuel flow rate profile line 522. Decision block 414 of the exemplary flowchart 400 would indicate a "1" whereat injected fuel masses at each of the first and second fuel injection events deviate from a corresponding desired injected fuel mass, e.g., 4.0 mg in the illustrated embodiment. It will be appreciated that each of the fuel injection events can include a corresponding desired injected fuel mass that is different from the other fuel injection event. Therefore, while the second fuel injection event is now indicative of being stable, the injected fuel mass undesirably deviates from the corresponding desired injected fuel mass.

Figure 6:
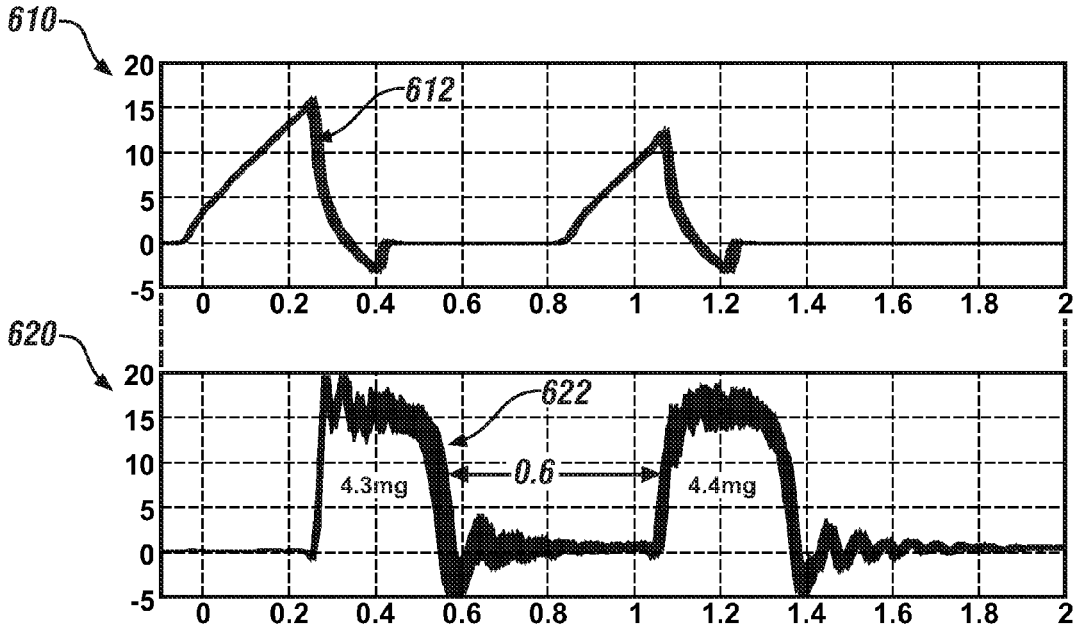
FIG. 6 illustrates an exemplary first plot 610 representing a measured current and an exemplary second plot 620 representing a measured fuel flow rate for two successive fuel injection events each characterized by bi-directional current waveforms having adjusted commanded injection durations, in accordance with the present disclosure.

FIG. 6 illustrates a non-limiting first plot 610 representing a measured current and a non-limiting second plot 620 representing a measured fuel flow rate for two successive fuel injection events each characterized by bi-directional current waveforms having adjusted commanded injection durations. The horizontal x-axis in each plots 610 and 620 denotes time in milliseconds (ms). The non-limiting exemplary first and second plots 610, 620, respectively, can be described with reference to the non-limiting exemplary first and second plots 510, 520, respectively, of FIG. 5.

While application of the reverse current flow incrementally applied to the electrical coil after the commanded injector closing time was effective to stabilize each of the fuel injection events in the non-limiting exemplary plot 520 of FIG. 5, the injected fuel masses at each of the first and second fuel injection events deviated from a corresponding desired injected fuel mass, e.g., 4.0 mg. Accordingly, non-limiting exemplary plots 610 and 620 of FIG. 6 compensate for the undesirable deviation by adjusting the injector duration of the first and second fuel injection events such that the corresponding desired injected fuel mass is achieved at each fuel injection event, as described above with reference to block 416 of the exemplary flowchart 400 of FIG. 4.

Referring to the first plot 610, measured current profile lines 612 each correspond to a respective engine cycle for the two fuel injection events are illustrated. The vertical y-axis denotes current in Amperage (A). Each measured current profile line 612 indicates a measured bi-directionally electrical current flow through the electrical coil 24 (i.e. injector activation signal), as described above with reference to the non-limiting exemplary plot 510 of FIG. 5. In the illustrated embodiment, the injector duration of the first fuel injection event is increased and the injector duration for the second fuel injection event is decreased to compensate for the deviations in the injected fuel masses illustrated by the fuel flow rate profile line 522 of the non-limiting exemplary plot 520 of FIG. 5.

Referring to the second plot 620, a plurality of measured fuel flow rate profile lines 622 each corresponding to the respective engine cycle for the two fuel injection events are illustrated. A dwell time representing a period of time separating the first and second fuel injection events is about 0.6 ms and is less than the dwell time threshold. The vertical y-axis denotes fuel flow rate in milligrams (mg) per millisecond (ms). The plurality of measured fuel flow rate profile lines 622 indicate that the first and second fuel injection events are indicative of being stable and that the injected fuel mass at each injection event substantially achieves the corresponding desired injected fuel mass. For instance, the injected fuel mass at the first fuel injection event is now 4.3 mg and the injected fuel mass at the second fuel injection event is now 4.4 mg as a result of the adjustments to the injector durations.

The results obtained from each of the non-limiting exemplary plots of FIGS. 3, 5 and 6 can be stored within one or more memory devices corresponding to the control module 60 and/or the external ECM 5, and employed for adaptive learning, as described above with reference to block 418 of the exemplary flowchart 400 of FIG. 4.

Figure 7:
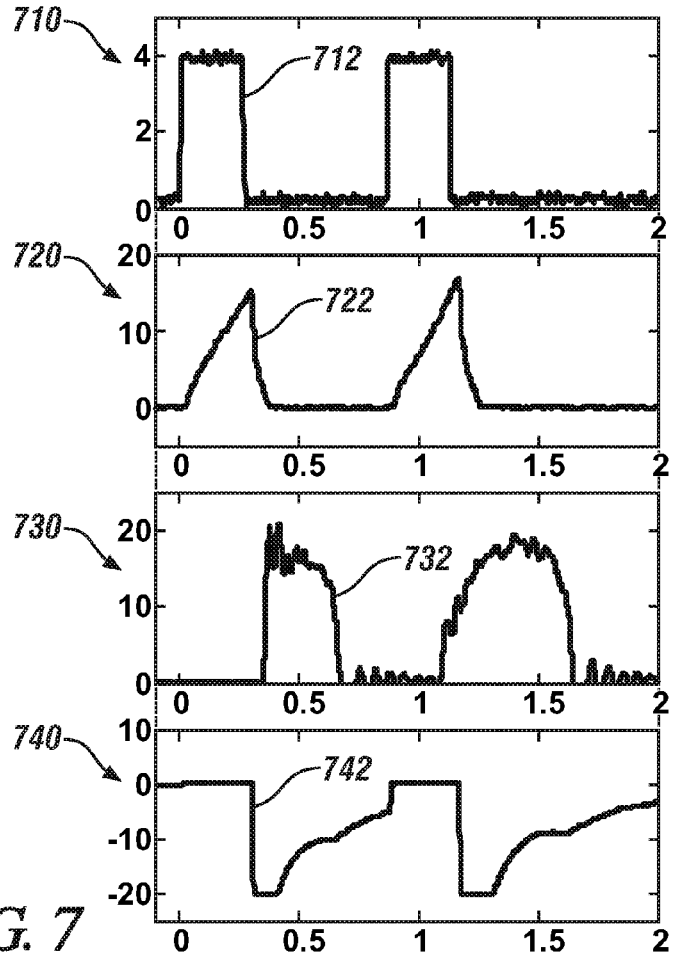
FIG. 7 illustrates a plurality of exemplary plots representing voltage feedback control for two successive fuel injection events characterized by an identical injector duration with the intent to each achieve an identical desired injected fuel mass, in accordance with the present disclosure.

FIG. 7 illustrates a plurality of non-limiting exemplary plots representing voltage feedback control for two successive fuel injection characterized by an identical injector duration to each achieve an identical desired injected fuel mass. The horizontal x-axis in each of plots 710-740 denotes time in milliseconds (ms).

Referring to plot 710, measured voltage supply profile line 712 represents a commanded injector pulse signal (e.g., injector command signal 52) provided from the control module 60 to the injector driver 50 of FIG. 1-1. The injector pulse signal achieves the desired injector duration for achieving the desired injected fuel mass, and corresponds to the injector command signal 52 described above with reference to the non-limiting exemplary embodiment of FIG. 1-1. The vertical y-axis denotes voltage in Volts (V). The measured voltage supply profile line 712 is increased from 0 V between 0 ms and 0.3 ms to open the fuel injector at the first fuel injection event and is increased from 0V between 0.9 ms and 1.1 ms to open the fuel injector at the second fuel injection event.

Referring to plot 720, measured electrical current profile line 722 represents measured electrical current flow applied to energize the electrical coil 24 to open the fuel injector at the first and second fuel injection events, respectively. The measured electrical current flow increases and decreases in response to the measured voltage supply profile line 712 of plot 710. It will be appreciated that no reverse current flow is applied after the injector is commanded to close, and thus, the presence of magnetic flux can result due to persistent eddy currents after each fuel injection event.

Referring to plot 730, measured fuel flow rate profile line 732 represents a measured fuel flow rate for each of the first and second fuel injection events. For instance, the measured fuel flow rate profile line 732 corresponds to one of the measured fuel flow rate profile lines 322 described above with reference to the non-limiting exemplary plot 320 of FIG. 3. It will be appreciated that while the commanded injector duration (e.g., injector command signal 52) is identical for each of the first and second fuel injection events, the duration of the second fuel injection event is longer than the duration of the first fuel injection event. Accordingly, the second fuel injection event undesirably results in a larger injected fuel mass delivered than that of the first fuel injection event.

Referring to plot 740, measured residual voltage profile line 742 represents a measured residual voltage across the electrical coil 24. In one embodiment, a corresponding sensor can be integrated within the activation controller 80 of FIG. 1-1 to directly measure the residual voltage. In another embodiment, a corresponding sensor can be integrated within the fuel injector to directly measure the residual voltage. In yet another embodiment, one or more parameters obtained from corresponding sensor integrated within the fuel injector can be provided via feedback signal(s) 42 to the control module 60, and used as proxies by the control module 60 to estimate the measured residual voltage. In the illustrated embodiment, when the measured voltage profile line 742 is increasing from a negative value, a discernible residual voltage inflection point is indicated at about 0.7 ms and at about 1.6 ms. The residual voltage inflection point at about 0.7 ms corresponds to the injector closing time (e.g., EOI time) of the first fuel injection event and the residual voltage inflection point at about 1.6 ms corresponds to the injector closing time (e.g., EOI time) of the second fuel injection event. These closing times correspond to the armature reaching the rest position. Advantageously, residual voltage inflection points can be easily identified to indicate when injector closing times occur, which can be utilized to calculate the injector duration and the injected fuel mass actually delivered. Moreover, instability in second fuel injection event can be determined when the residual voltage inflection point occurs at non-repeating, or otherwise inconsistent, time points between each engine cycle. In other words a variable residual voltage inflection point indicating that the residual voltage inflection point varies from engine cycle to engine cycle can indicate that the corresponding fuel injection event is unstable.

Figure 8:
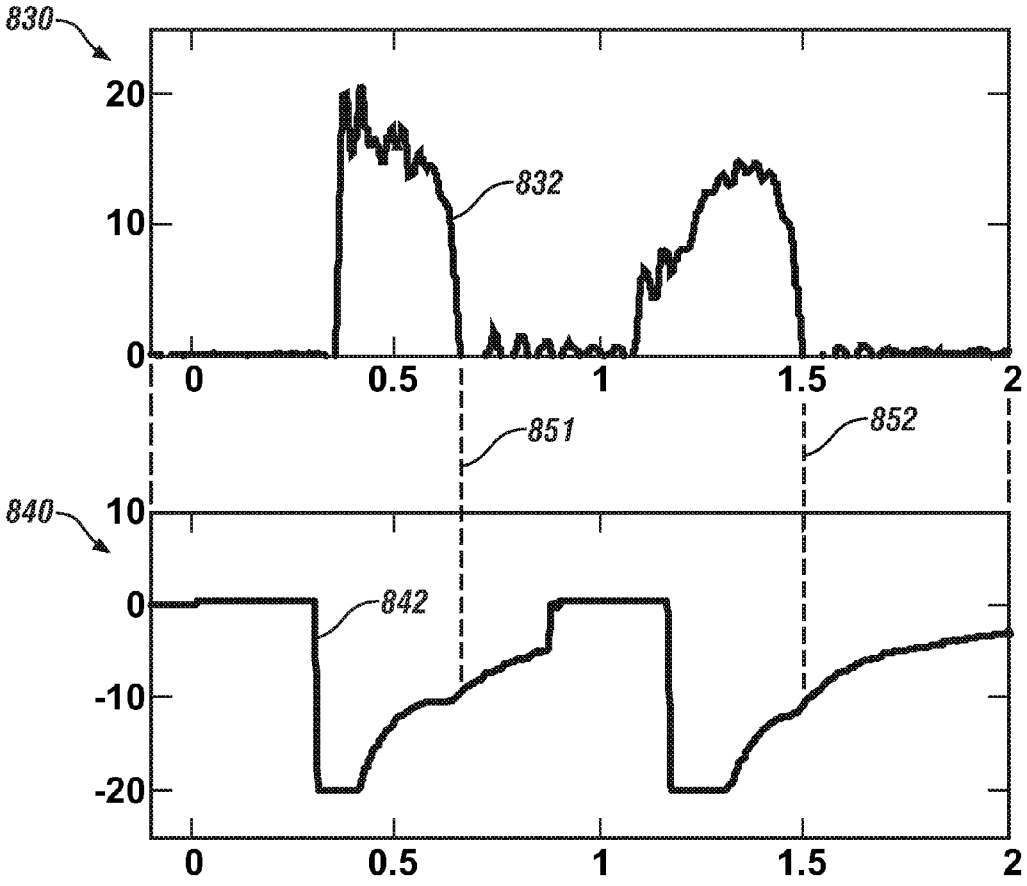
FIG. 8 illustrates an exemplary first plot 830 representing a measured fuel flow rate and an exemplary second plot 840 representing a measured residual voltage across an electrical coil of a fuel injector, in accordance with the present disclosure.

FIG. 8 illustrates a non-limiting exemplary first plot 830 representing a measured fuel flow rate and a non-limiting exemplary second plot 840 representing a measured residual voltage across an electrical coil of a fuel injector. The plots 830 and 840 can be described in comparison to the non-limiting exemplary plots 730 and 740, described above with reference to FIG. 7.

Referring to plot 830, measured fuel flow rate profile line 832 represents a measured fuel flow rate for each of the first and second fuel injection events. For instance, the measured fuel flow rate profile line 832 corresponds to one of the measured fuel flow rate profile lines 322 described above with reference to the non-limiting exemplary plot 320 of FIG. 3. Compared to the injector duration of the second fuel injection event of non-limiting exemplary plot 730 of FIG. 7, the injector duration of the second fuel injection indicated by the measured fuel flow rate profile line 832 is reduced resulting in a lower actual injected fuel mass. Specifically, the injector closing time (EOI time) of the second fuel injection event occurs earlier at about 1.5 ms compared to the injector closing time of the second fuel injection event of plot 730 of FIG. 7 at about 1.6 ms.

Referring to plot 840, measured residual voltage profile line 842 represents a measured residual voltage across the electrical coil and provided as feedback via feedback signal(s) 42. In the illustrated embodiment, the measured voltage profile line 842 depicts a discernible residual voltage inflection point indicated at about 0.7 ms and at about 1.5 ms. The residual voltage inflection point at about 0.7 ms corresponds to the injector closing time (e.g., EOI time) of the first fuel injection event as indicated by dashed vertical line 851, which is identical to the injector closing time of the first fuel injection event of plot 740 of FIG. 7. However, the residual voltage inflection point at about 1.5 ms corresponds to the injector closing time (e.g., EOI time) of the second fuel injection event as indicated by dashed vertical line 852, which is earlier in time than the voltage inflection point of plot 740 of FIG. 7 corresponding to the injector closing time of the second fuel injection event.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A method for reducing performance variation of an electromagnetically-activated actuator including an electrical coil and an armature, comprising:

providing actuator activation signals to the electromagnetically-activated actuator comprising current driven through the electrical coil in a first direction;

detecting unacceptable response variations in the armature to equivalent actuator activation signals; and subsequent to detection of unacceptable response variations in the armature, driving current through the electrical coil in a direction opposite that of the first direction following actuator activation signals.

2. The method of claim 1 wherein detecting unacceptable response variations in the armature comprises:

subsequent to each actuator activation signal, sensing a respective voltage inflection in the electrical coil indicative of the armature reaching a rest position; and detecting variability in timing among the respective voltage inflections, wherein unacceptable response variations correspond to unacceptable variability in timing.

3. A method for reducing performance variation of an electromagnetically-activated fuel injector including an electrical coil and an armature, comprising:

providing injector activation signals to the electromagnetically-activated fuel injector comprising driving a first current through the electrical coil in a first direction;

subsequent to each injector activation signal, sensing a respective voltage inflection in the electrical coil indicative of the armature reaching a rest position;

detecting variable timing among the respective voltage inflections, wherein unacceptable response variations correspond to unacceptable variable timing; and subsequent to detection of unacceptable response variations, driving a second current through the electrical coil in a direction opposite that of the first direction and following injector activation signals.

4. The method of claim 3 wherein detecting variable timing among the respective voltage inflections comprises detecting variable timing between adjacent respective voltage inflections.

5. The method of claim 3 wherein driving the second current through the electrical coil comprises:

increasing the second current corresponding to a present detection of a respective unacceptable response variation relative to the second current corresponding to a prior detection of a respective unacceptable response variation.

6. The method of claim 3 further comprising detecting stable timing among the respective voltage inflections and determining a fuel mass delivered by the injector based upon said stable timing.

7. The method of claim 6 further comprising adjusting the injector activation signals to converge the fuel mass delivered by the injector to a desired fuel mass to be delivered by the injector.

8. The method of claim 6 further comprising storing the second current sufficient to establish stable timing among the respective voltage inflections to a non-volatile memory device.

9. The method of claim 7 further comprising storing the adjusted injector activation signals to a non-volatile memory device.

10. A system for controlling actuation of a fuel injector, comprising:

a fuel injector comprising an electrical coil and an armature;

an injector driver responsive to an injector command signal for driving current through the electrical coil; and a control module configured to:

actuate the injector by providing the injector command signal to the injector driver effective to drive a first current through the electrical coil in a first direction;

subsequent to the first current through the electrical coil, sense a voltage inflection in the electrical coil indicative of the armature reaching a rest position;

determine a timing of the voltage inflection, detect a timing variation between the timing of the voltage inflection and a timing of a prior voltage inflection corresponding to an immediately prior injector actuation;

determine an unacceptable injector response variation based on an unacceptable timing variation; and subsequent to detection of the unacceptable injector response variation, provide the injector command signal to the injector driver effective to drive a second current through the electrical coil in a direction opposite that of the first direction.

11. The system of claim 10 wherein the injector command signal to the injector driver effective to drive the second current through the electrical coil is effective to increase the second current corresponding to a present injector actuation relative to the second current corresponding to the immediately prior injector actuation.

12. The system of claim 10 wherein the control module is further configured to detect a timing stability between the timing of the voltage inflection and the timing of the prior voltage inflection corresponding to the immediately prior injector actuation and determine a fuel mass delivered by the injector based upon said timing stability.

13. The system of claim 12 wherein the control module is further configured to adjust the injector command signal to converge the fuel mass delivered by the injector to a desired fuel mass to be delivered by the injector.

14. The system of claim 12 wherein the control module is further configured to store the second current sufficient to establish said timing stability between the respective voltage inflections to a non-volatile memory device.

15. The system of claim 13 wherein the control module is further configured to store the adjusted injector activation signal to a non-volatile memory device.

* * * * *